United States Patent [19]

Caumont

[11] Patent Number: 4,658,477

[45] Date of Patent: Apr. 21, 1987

[54] METHOD OF MAKING A HYDROPHILIC COTTON "FLEECE", AND A FLEECE OBTAINED IN ACCORDANCE WITH THE EMPLOYMENT OF THIS METHOD, AND PIECES OF COTTON OF ANY FORM WHICH ARE OBTAINED BY CUTTING THIS FLEECE UP

[75] Inventor: Jean-François Caumont, Brionne, France

[73] Assignee: Tempo Sanys, Paris, France

[21] Appl. No.: 634,720

[22] Filed: Jul. 26, 1984

[30] Foreign Application Priority Data

Sep. 21, 1983 [FR] France ..... 83 15026

[51] Int. Cl.[4] ..... D01B 9/00

[52] U.S. Cl. ..... 19/66 CC; 19/66 R; 8/154; 8/156

[58] Field of Search ..... 68/189, 13 R; 8/154, 8/156; 19/66 R, 66 C

[56] References Cited

U.S. PATENT DOCUMENTS

| | | | |
|---|---|---|---|
| 1,460,519 | 7/1923 | Wadsworth | 19/66 R |
| 1,596,715 | 8/1926 | Byers et al. | 19/66 R |
| 2,250,085 | 7/1941 | Stienen | 68/189 |
| 2,280,326 | 4/1942 | Kornegg | 19/66 R X |
| 2,803,125 | 8/1957 | Mesek | 19/66 R X |
| 2,845,787 | 8/1958 | Fick | 68/189 |
| 2,895,176 | 7/1959 | Wade | 19/66 R |
| 3,476,501 | 11/1969 | Lorenz et al. | 68/189 X |
| 3,802,838 | 4/1974 | De La Serviere | 19/66 X |
| 3,834,869 | 9/1974 | Ancelle et al. | 19/66 R X |
| 3,968,541 | 7/1976 | Rasmussen | 19/66 R |
| 4,243,446 | 1/1981 | Mathey | 19/66 R X |

*Primary Examiner*—Harvey C. Hornsby
*Assistant Examiner*—Frankie L. Stinson
*Attorney, Agent, or Firm*—Seidel, Gonda, Goldhammer & Abbott

[57] ABSTRACT

The invention concerns a method of making a hydrophilic cotton fleece. The method is characterized in that during the operations of boiling and bleaching in the autoclave, treatment liquids are made to circulate radially through the turns of the coil in such a manner that a differential pressure is established between the liquid entering the coil and the liquid leaving the coil as a result of load losses due to the difficulty which the liquid experiences in passing through the coil. The invention is applied to the manufacture of a cotton fleece with improved adherence.

5 Claims, 3 Drawing Figures

Figure 1:
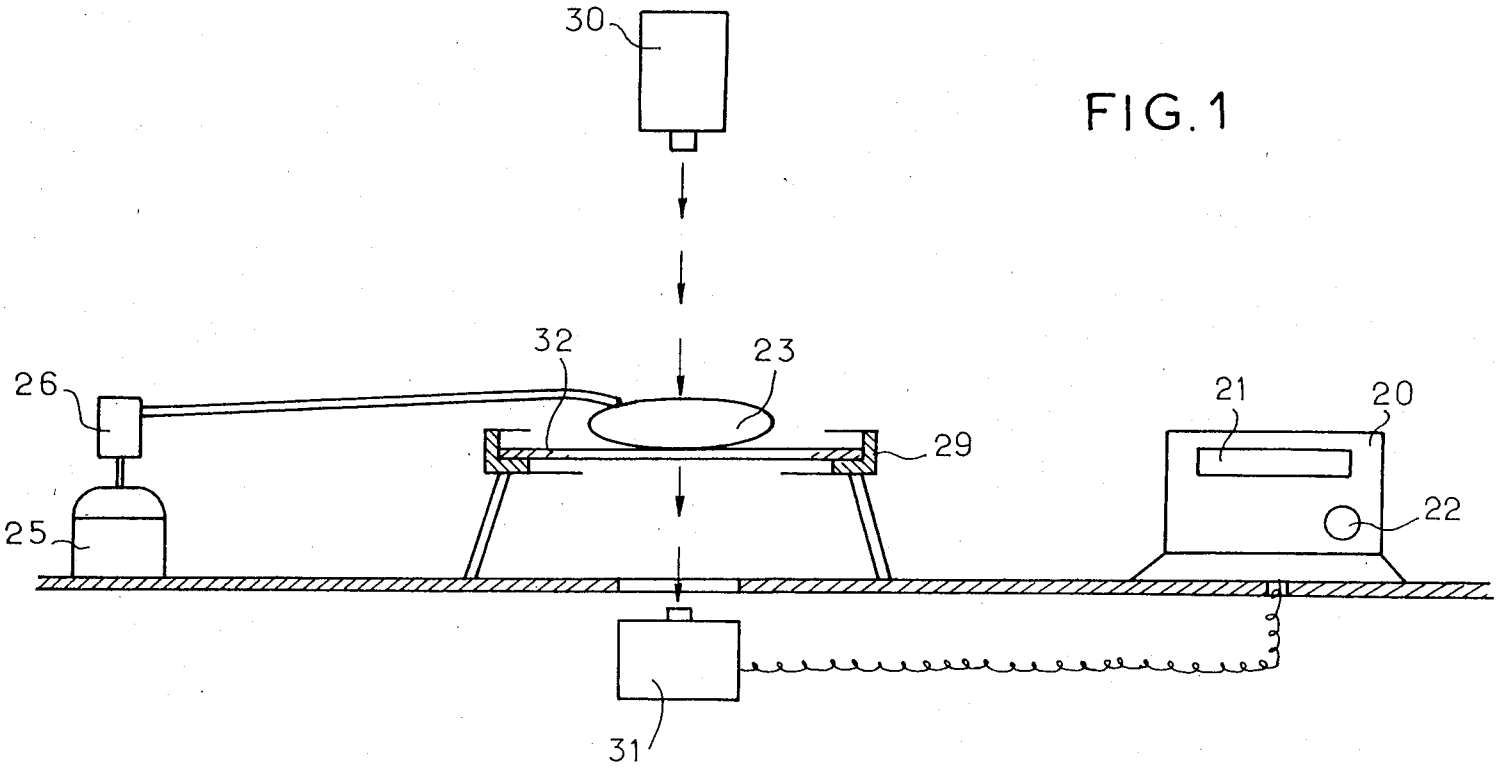

METHOD OF MAKING A HYDROPHILIC COTTON "FLEECE", AND A FLEECE OBTAINED IN ACCORDANCE WITH THE EMPLOYMENT OF THIS METHOD, AND PIECES OF COTTON OF ANY FORM WHICH ARE OBTAINED BY CUTTING THIS FLEECE UP

The present invention relates to a method of making a hydrophilic cotton fleece starting from fibres of raw cotton, more particularly starting from carding noils obtained as waste in the process of preparation of cotton fibres for spinning and weaving.

All the methods of treatment of cotton that are now used start with very tightly packed bales which are supplied by the producer and which have to be loosened, spread and then cleaned in order to eliminate the vegetable refuse such as stems, leaves and knots of fibres.

In the course of this preliminary operation the longest fibres are graded for spinning and weaving.

The waste from this first operation of grading or combing, generally called combing noils, are regarded in cotton technology as high-grade waste serving as raw material for processes of manufacture of hydrophilic cotton, make-up removing products, pharmaceutical or surgical tampons, nappies for babies and so on. This waste consists of good fibres which have been well loosened and are very clean and contain little vegetable refuse or other contaminating agents.

The conventional treatment of such noils is to subject the fibres of raw (and therefore unbleached) cotton to preliminary beating and opening operations so as to obtain cotton in the form of flocks which have been opened and cleaned physically, and then subjecting the flocks to boiling-off for removing the greases (pectins, fat elements and so on) which are round the fibre and thus making the fibre hydrophilic. Boiling-off is generally carried out with the aid of a soda solution. It is generally followed by a bleaching operation, more particularly by means of oxygenated water for the purpose of giving the cotton fibres the necessary whiteness to permit them to be offered for sale. The cotton that has been subjected to this boiling and bleaching operation is then introduced into a carding unit in which it is treated on cards which comb the cotton fibres very finely, align them parallel to one another, separate them from one another and make them into a fleece which is then treated.

More particularly, for areas of usefulness in which it is desirable to obtain cotton fleeces having a certain firmness, such as babies' nappies, sanitary towels, certain surgical tampons, or even round wads for removing make-up which have recently appeared on the market, it has been regarded as important to modify the standard method described above, by performing the boiling and bleaching operations not on the cotton in flocks but on an unbleached fleece which already has a certain cohension; this process has the advantage that it can be carried out in the autoclave in which the operations of boiling and bleaching the "coils" wound on a cylinder are carried out. When the cotton leaves the autoclave it is only necessary to unroll the fleece, squeeze it and dry it in a manner known per se before "stirring", cutting up and so on. In accordance with these processes, which have been described more particularly in French Pat. Nos. 1 478 515 and 2 081 133, for the manufacture of the fleece before it is wound on to the cylinders, the flocks of unbleached cotton are taken to perforated cylinders on which they deposit themselves fairly uniformly to form a loose fleece that has practically no cohesion, this fleece is taken to a wetting bath consisting of warm water (50° to 60°) to which a wetting agent has been added to densify the fleece and prepare it for the subsequent boiling and bleaching operation, so as to obtain a more compact fleece having a certain firmness because of physical cohesion, and then, when the fleece leaves the wetting bath, this fleece is dried between calender rollers and is wound on a cylinder which is then introduced into the autoclave in order to be subjected, in the autoclave, to the boiling and bleaching operations.

On passing into the wetting bath the cotton fleece originally fluffy, is made compact; it could be observed that the fleece lost more than 9/10 of its thickness. This compactness is associated with the aquisition of a certain adhesion in consequence of attachment of the fibres to one another resulting from the fact that the cotton fibres have a tendency to curl and enttangle with one another as a result of their contact with the warm water. These physical connections of the fibres to one another proceed still further during the operations of boiling and bleaching in the autoclave when the cotton is being treated in a basic medium at a temperature of 125° C.

This method has made it possible to obtain a cotton fleece having a certain cohesion; the expression "cotton felt" has even been used sometimes. However, it has been possible to observe that the cohesion of the fleece thus obtained was insufficient for certain areas of usefulness, more particularly for round wads which have to be used for removing make-up or for cleaning babies. The present invention therefore concerns a method which makes it possible to obtain very cohesive cotton fleeces.

For this purpose, the invention concerns a method which is characterised in that during the operations of boiling and bleaching in the autoclave, treatment liquids are made to circulate radially through the turns of the coil in such a manner that a differential pressure is established between the liquid entering the coil and the liquid leaving the coil, in consequence of load losses resulting from the difficulty which the liquid experiences in passing through the coil. This differential pressure causes displacement and entanglement of the cotton fibres as a result of "hydraulic tufting" over the whole of the wound fleece constituting the coil, thus greatly increasing the cohesion of the said fleece.

The method according to the invention makes it possible largely to increase the cohesion of the fleece, by combination of the effect of physical adhesion of the cotton fibres which tend to curl and tangle with one another under the action of the treatment liquid (soda at a temperature of about 125° C. for boiling), on the one hand, and on the other hand the effect of "hydraulic tufting" which is obtained when the treatment liquids passes through the coil.

This effect of "hydraulic tufting" has already been mentioned, more particularly in French Pat. Nos. 1 498 554 and 2 265 891; it consists, in fact, of obtaining, by means of "jets" of liquid, an effect similar to that obtained by the standard tufting operations which consist in sinking needles into the mass of fibres which are to be treated and then withdrawing these needles, so that under their action the fibres entangle within the fleece.

According to the invention, this effect is found to be substantially greater than in the standard methods described in the two patents referred to above, by reason of the fact that we now have an additional operation applied to a coil comprising numerous turns corresponding to a wound fleece length which may exceed 1000 meters. Moreover, this is not a treatment at various points by means of nozzles but a treatment over the whole surface of the fleece.

According to another characteristic of the invention the autoclave is connected to a closed treatment liquid circulation circuit comprising a channel through which the liquid enters the coil and a channel through which this liquid leaves, and a powerful pump capable of taking in the liquid that comes from the coil and of sending this liquid back to the coil.

According to another characteristic of the invention, the closed liquid circulation circuit comprises a bypass duct provided with an adjustable valve provided between the treatment liquid inlet channel and the liquid outlet channel. Alteration of the adjustement of the valve causes change in the differential pressure present between the entry to and the exit from the coil, and consequently a change in the cohesion properties of the fleece leaving the autoclave.

This possibility of adjustment is very important, in accordance with the invention, in view of the fact that the required cohesion (which increases with the differential pressure) will have to be greater or less according to the object aimed at. For example, products intended for baby toilet have to be softer, and therefore their fibres must cling together less strongly, than in the case of products intended for removing make-up.

The method with the invention is concerned can be carried into effect in a relatively simple way.

In fact, for this reason and in accordance with a further feature of the invention, before the fleece is subjected to the operations of boiling and bleaching in the autoclave the fleece is wound on a hollow cylinder which comprises perforations which are distributed uniformly over its surface, and the coil thus obtained is enclosed in a cylindrical jacket, more particularly a metal jacket, which has on its periphery (sic) perforations similar to those provided on the cylinder; the end of the cylinder is connected to the channel through which the treatment liquid comes, and the autoclave comprises an orifice which can be connected to the channel through which this liquid goes out.

Thus, according to the invention, each of the perforations of the cylinder corresponds to a liquid jet passing through the rolled fleece (at right angles to the axis of this roll) and causing displacement of fibres.

It has been possible to observe that the presence of the jacket was essential for maintaining the turns which contitute the coil, during the boiling and bleaching operations and also during the rinsing operation which follows these. In fact, without the jacket the coil would "burst" under the action of the pressure of the treatment liquid delivered by the pump.

According to another feature of the invention the differential pressure may be adjusted, according to the required cohesion, between 200 and 800 grammes. This differential pressure may be adjusted to a lower level in order to obtain less cohension fleeces or to a higher level in order to obtain very firm felts.

The present invention also relates to a cotton fleece obtained in accordance with the employment of the method described above, and also to pieces of cotton of any shape which are obtained as a result of cutting up a fleece of this kind.

As already indicated above, pieces that have been cut out in this way are generally offered for sale in the form of round wads, more particularly round wads of which the diameter is about 6 cm.

Because of the purposes for which they are used, the right properties required of a fleece of this kind are that it should be sufficiently soft for the skin while having sufficient strength and therefore sufficient cohesion not to tear during use, or to become fluffy. Another important property is related to the possibility of absorbing the pharmaceutical or cosmetological liquids that are ordinarlly used, and of doing this without impairment of the cohesion. However, this absorption must not be too rapid to allow the user time to spread the treating products on the skin.

According to another characteristic of the invention, the round wads cut out of the fleece have a longitudinal strength which is between 12 and 20 Newtons.

According to another feature of the invention, the round wads cut out from the fleece have a transverse resistance which is between 10 and 15 Newtons.

According to another feature of the invention, the round wads cut out from the fleece have a tearing strength in the direction of the thickness which is between 3 and 4 Newtons.

The properties of the fleece and the round wads according to the invention will be studied in the following paragraphs.

STUDY OF THE APPARENT DENSITY

The hydraulic tufting to which the fleece wound in rolls is subjected during the boiling and whitening treatments in the autoclave makes the cohesion of the fibres much greater than in the case of the prior art processes. This cohesion quite obviously involves an increase in the apparent density of the fleece in accordance with the present invention, or of the round wads cut off from this fleece: this property can be observed by simply touching these round wads. It can be demonstrated in a more precise manner by means of a standard test in the field of quilting which is known as the "micronaire" test, in which a given weight of cotton, more particularly 5 grammes, (corresponding to several round wads) is placed in a receptacle provided on the apparatus, and a current of air produced by a vacuum pump is passed through this. The difference in pressure between the air upstream from the cotton and the air downstream is then measured. The value of the differential pressure that is found, which is generally measured on the basis of the height of a column of water, varies with the permeability of the fleece of cotton in question to air, and consequently varies with the apparent density. It is in fact obvious that the permeability to air is less when the apparent density of the cotton is greater.

A micronaire apparatus of this kind was used for comparing the air-permeability of round wads of cotton obtained in accordance with the method to which this invention relates, with the air-permeability of round wads of cotton having the same weight and obtained in accordance with prior art methods (specimens 2, 3, 4 and 5). The results obtained, each of which corresponds to a means of results observed with specimens obtained by identical processes, are collected in Appendix 1. The apparatus used was graduated in such a manner that the value read on the column, at the right, was greater when the permeability to air was less and, therefore, when the density was greater. This table therefore clearly shows that the apparent density of the round wads obtained in accordance with the method to which the invention relates (specimen 1) is clearly higher than that of the specimens obtained by carrying the methods according to the prior art into effect (specimens 2, 3, 4 and 5).

This greater density and therefore this better cohesion of the cotton fleece obtained by carrying into effect the method to which the present invention relates, or of the pieces, particularly round wads, cut out from this fleece, also implies greater firmness than that of the round wads in accordance with the prior art. Various experiments, of which the results are assembled hereunder, have been carried out to demonstrate this firmness.

STUDY OF RESISTANCE TO STRETCHING

This study, too, was carried out with similar specimens approximately equal to one another in diameter. An apparatus referred to as dynamometric was used. The disc to be studied was clamped between two jaws of this dynamometer and these (sic) were moved apart little by little. For each specimen we measured the force corresponding to maximum elongation of the disc, that is to say the elongation at which the force begins to decrease, which corresponds to commencement of breakage of the specimen.

We were able to establish that for certain specimens, more particularly those in accordance with the prior art, there were great differences between the forces measured in the direction of the machine or direction of the fibres F, and in the direction i at right angles to this. For each specimen group corresponding to a commerical product, therefore, we measured the force F in the direction of the machine and the force in the transverse direction i.

The results obtained are assembled in the table appearing in Appendix 2. For each group of specimens (Specimen 1 corresponds to the product obtained by carrying the method according to the invention into effect, whereas Specimens 2, 3, 4 and 5 correspond to prior art processes) we made several measurements and calculated the mean values.

This table shows clearly the difference between the cohesion of Specimen 1 which corresponds to round wads made in accordance with the employment of the method according to the invention, the Specimens 2, 3, 4 and 5 which correspond to round wads in accordance with the method of the prior art. It is to be noted that according to the invention there is a high value of the resistance to stretching both in the machine direction and in the transverse direction. This resistance is always clearly greater than that measured in the case of Specimens 2, 3, 4 and 5. The variations observed in the case of these specimens, and, in particular, the variations of the differences of the values in the machine direction and in the transverse direction, represent the isotropy of the round wads. It is clear that the effect of hydraulic tufting obtained, in accordance with the invention, in the course of boiling and bleaching, greatly incresses the cohesion of the fleece, and does this in all directions, which is the normal result in view of the fact that this is a treatment in volume of the turns of fleeces wound round the perforated cylinder, and this takes place without any favoured direction.

Appendix 2 also shows the values of the elongations corresponding to drawing with a force similar to that studied above. These maximum elongations corresponding to the commencement of breakage confirm the result observed above, that is to say that the cohesion of the fleece obtained in conformity with the process according to the invention is clearly greater than that of the fleeces obtained in conformity with the employment of the processes of the prior art, and this is true both in the direction of the machine and also in the transverse direction.

This result is also confirmed in the table appearing in Appendix 3 which shows all the values, for these various specimens, of the relationship k obtained as the quotient of the forces and the elongations measured in accordance with the tables shown in Appendix 2.

It can be concluded, from the tables shown in Appendices 2 and 3, that the resistance to stretching in the two directions (machine direction and transverse direction), in the case of a fleece which has itself been obtained by the employment of the method according to the invention, is clearly greater than the resistance to stretching of the fleeces in accordance with the prior art.

STUDY OF THE RESISTANCE TO TEARING IN THE DIRECTION OF THE THICKNESS

For this study, an adhesive ribbon was stuck to each surface of the discs to be studied and the ends of these ribbons were introduced into the jaws of a dynamometer identical with the one referred to above. The force needed to separate the fibres in the direction of the thickness of the fleece is greater or less according to the extent of the cohesion of the fibres between themselves. Therefore, as before, the value of the force corresponding to maximum elongation, that is to say the force at which commencement of breakage of the fleece is first observed, gives an idea of the cohesion in the direction of the thickness.

Measurements were made on the basis of specimens similar to those used previously. The results obtained are collected in the table appearing in Appendix 4.

The results in this table are in fact similar to those found previously, that is to say they prove, once again, that the cohesion of the fleece obtained in accordance with the method with which the invention is concerned, is clearly superior to that of fleeces obtained by the employment of the methods in accordance with the prior art.

STUDY OF THE ABSORPTION PROPERTIES

As has already been indicated, in order to achieve the object of the invention (removal of make-up, baby toilet and so on) the round wads cut off from the fleece must be capable of absorbing liquids to a certain extent. However, the speed of absorption must not be too great, because in the case of round wads for removing make-up, for example, the lotion must not disappear instantaneously into the round wad even before the user has applied it to her face.

The greatest cohesion of the fleece obtained in accordance with the method to which the invention relates implies less absorption than in the case of the fleeces obtained by the employment of the prior art processes.

It was possible to verify this result by a certain number of tests which were made with the specimens already studied previously. The results of these tests are all shown in the table which appears in Appendix 5.

In the course of these tests we successively measured, for each group of specimens, the mean weight of a round wad and then the maximum quantity of water that could be absorbed by these round wads. The relationship of this mass of water to the original mass of the disc gives the percentage of its weight capable of being absorbed by each specimen disc. The table appearing in Appendix 5 shows the Specimen 1 (method in accordance with the invention) absorb about 6.5 times its own weight of water, wherseas the specimens prepared for carrying the prior art methods into effect (Specimens 2 to 5) all absorb about 9 times their own weight. There we have a sibstantial difference which is a direct result of the better cohesion and better uniformity of Specimen 1 which has been subjected to the process of hydraulic tufting in volume in accordance with the invention.

This result is confirmed by the speed of absorption which appears in the column on the right in the same table.

In order to improve these results still further and study more precisely the speed of absorption of the discs made by carrying into effect the method with which the invention is concerned (the parameter to be considered), we have designed and constructed a specific measurement apparatus which is illustrated in FIG. 1.

According to FIG. 1, this apparatus consists of a cell 30 emitting an infrared beam and a receiver 31 which delivers in response a voltage signal proportional to the "transparency", or permeability to infrared rays, of the objet measured.

The cell used may be for instance the SAS cell marketed by SUNX LTD. This voltage signal is read on the dial 21 of an electronic reading apparatus 20 also comprising a chronometer 22.

As shown in FIG. 1, a specimen round wad 23 which is to be studied is placed in the beam generated by the detecter upstream of the receiver. Disposed above the round wad 23 is a drip counter 25 having a device 26, more particularly a tap adapted to drip a predetermined quantity of water or other liquid on the specimen round wad 23 in that zone of its surfaces through which the infrared radiation passes. The residual power of the beam passing through the wad 23 increases in direct proportion to the impregnation of the test wad 23. Therefore, the reading on the dial 31 can give an idea of the absorption of the liquid by the wad 23. The distance therefrom to the drip counter 25 can be adjuted by means of specific members 29 not shown in detail in the Figure. Of course this distance should be fixed permanently for a series of comparative measurements.

Also, reopening of the tap 26 of the drip counter 25 to drop a predetermined quantity of liquid on the round wad 23 resting on a glass-plate 32 immediately starts the timer 22 provided for this purpose on the reading apparatus 20.

As previously stated, the figure appearing on the dial 21 depends directly on a "the obstacle" encountered by the infrared beam when it passes through the test speciemn 23; consequently, this figure varies according to the absorption proporties of the specimen with respect to the liquid delivered by the drip-counter 25. The initial value (at zero time) is related to the opacity of the test specimen and therefore depends on specimen thickness, density and composition, whereas the variation of the initial value in time is related directly to the absorption properties and more particuarly the absorption rate.

In attempts, to use the apparatus described to study the properties of the round wads prepared by the method according to the invention and by the prior art methods the curves plotting the variations of the reading to the dial 21 against of time were prepared for each of the five specimens studied previously. Of course the reading has no particular significance and depends solely on the adjustment of the apparatus, but the variations of the reading for the various specimens studied are definitely significant; the settings must of course remain the same throughout the experiment.

Appendix 6 shows the curves prepared from the five series of specimens after the injection of 2 $cm^3$ of water. Before the measurements were made, the apparatus was calibrated to measure variations from, 4,000 (maximum obstruction of the beam, due to the presence of any round wad of average dimensions) to 0 (maximum passage of the beam, when no object is interposed in its field). All these curves comprise two zones, a first zone, in which cuve slope is relatively steep and which corresponds to the actual absorption phase and a second zone, in which each curve becomes approximately horizontal and which corresponds to saturation of the specimen.

Clearly, the curves for specimens 2, 3, 4 and 5—i.e. the specimens prepared by the prior art methods are fairly similar and parallel to one another, whereas the curve for specimen 1 (method according to the invention) differs in two respects, the difference between the initial value and the saturation value is greater and the saturation point takes longer to reach.

This result shows that the round wads prepared in accordance with the invention are more compact than the prior art wads 5 thus confirming the earlier results which had already shown that they were more coherent. The major difference between the initial value and the saturation value is directly linked with this greater coherence, whereas the time it takes to reach the saturation value depends on the absorption rate, which is slower in the case of Specimen 1, something which as has already been seen, is an advantage in the case of round wads intended for the removal of make-up or for baby hygiene.

Each specimen studied was then tested for variations of the curves if 2 $cm^3$ of polyethylene glycol were injected instead of 2 $cm^3$ of water. Each time, it was possible to observe similare curves with these previous curves, more or less offset as regards their saturation value. The table of Appendix 8 shows the differences between the saturation values obtained with an injection of 2 $cm^3$ of water and with an injection of 3 $cm^3$ of water. Clearly for Specimen 1 (method in accordance with the invention) the saturation threshold is approximately constant, whereas for the prior art specimen (except for Specimen 4); There are considerable differences more particularly a lowering of this threshold. This proves that Specimen 1 can absorb the volumes of water considered without major strucural changes, this does not seem to be the case with the prior art specimens which change proportionally to their saturation. To get a more accurate idea of the properties of the various specimens, curves similar to the foregoing ones were plotted for an injection not of 2 $cm^3$ of water but of 2 $cm^3$ of a liquid having a higher viscosity, namely polyethylene glycol (viscosity 80 cP).

In the case of Specimen 1 a curve similar to the foregoing one was observed except for a lower saturation threshold.

With all the other specimens, the slope at the outset is appreciably lower i.e., the commencement of absorption is slower; instead of seing the curve descend immediately, there is a slow period; the curve even rising again in the case of Specimen 4. These observations show that, unlike the prior art wads, the round wads according to the invention behave stably in the presence of products having different viscosities a feature which is very advantageous for make-up removal products.

In conclusion, the foregoing experiments have proved that the wads in accordance with the invention differ from the prior art wads in that these of the present invention have greater coherence, greater tearing strength, more particularly to transversal tearing, and better absorption properties (non-immediate saturation, stability in the presence of products of various viscosities).

The characteristics of the method and of the products to which the invention relates will be described in further detail with reference to the accompanying drawings wherein.

Figure 2:
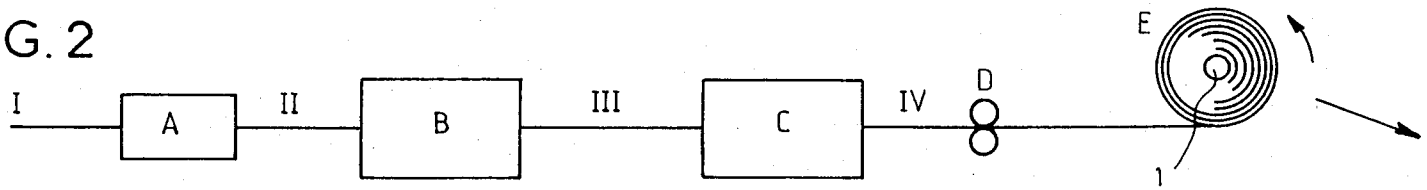
Figure 3:
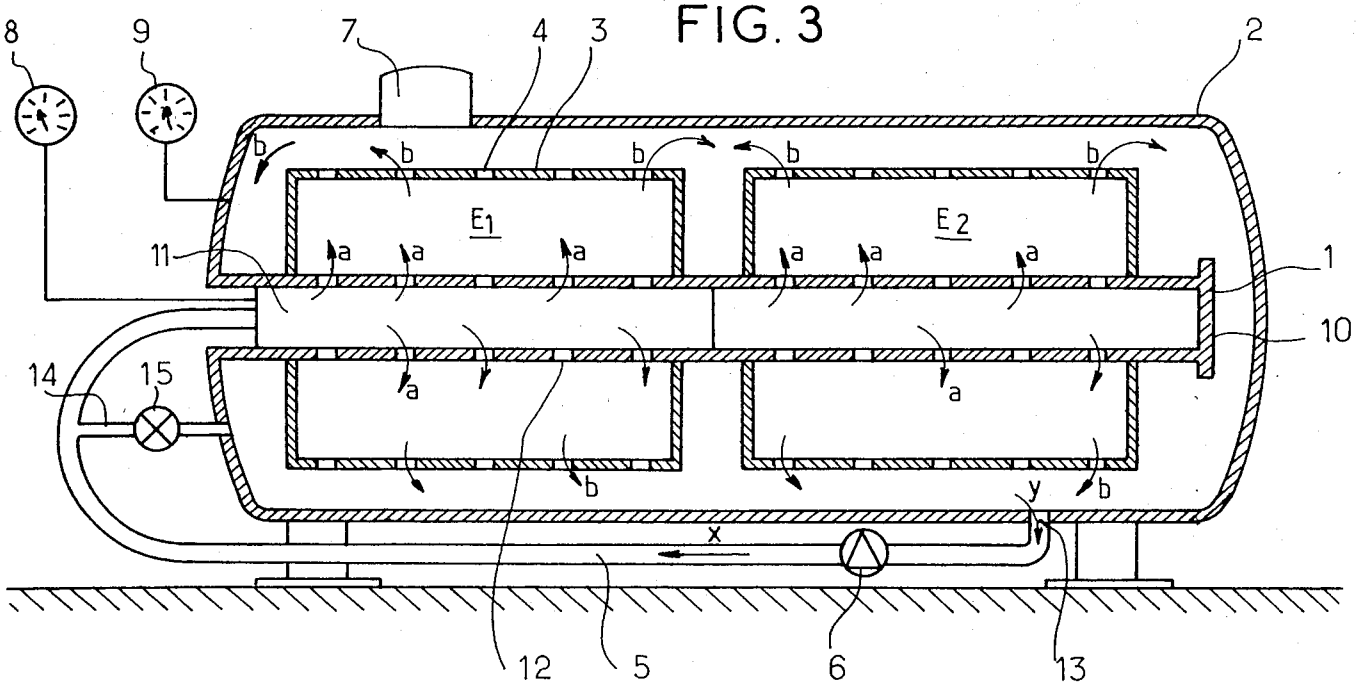

FIG. 1 diagrammatically illustrates the apparatus designed and constructed for measuring the speed of surface absorption, FIG. 2 is a block diagram of the method according to the invention, and FIG. 3 is a diagrammatic sectional view of the autoclave in which the operations of boiling-off and bleaching are carried out and of the closed treatment liquids circuit.

As shown in FIG. 2, the raw cotton used for the process, more particularly carding noils, is taken, to a first processing station A where it is given conventional preliminary beating and opening operations. The material leaves station A in the form of open and physically cleaned cotton flocks which are then taken, to a second station B comprising perforated cylinders within which there is a negative pressure. These cylinders, which are not shown in detail in FIG. 2, attract the flocks by the action of their internal vacuum. The material leaves station B in the from of a substantially uniform web which has a fluffy appearance and is virtually non cohering. The web which is about 8 cm thick goes to a station C comprising a wetting bath similar to the one described in French Patent Specification No. 2 081 133. The departing material is in the form of a web which is now only about 1.4 mm thick and therefore has been packed together considerably. The web, which has some cohesion due to the cotton fibres tending to curl and to become entangled with one another after having been brought into contact with the warm treatment liquid of Station C, are then dried between calender rollers D before being wound on a hollow cylinder 1 which will be described in greater detail hereinafter.

Therefore, after completion of the treatment operations diagrammatically illustrated in FIG. 2, reels or coils E are provided in the form of a cotton web IV which may be longer than 1 km and which is wound on a cylinder 1. Such coils E are ready for the boiling-off and bleaching operations which are illustrated in FIG. 3.

As shown in FIG. 3, two coils E1 and E2 are treated simultaneously. This is of course one particular example of the way in which the invention may be carried into effect and must not be regarded as limiting the invention in any way.

As shown in FIG. 3, coils E1 and E2 are placed end-to-end in the autoclave. Their forms are contiguous and are closed by a cover 10. On Their periphery (sic) the cylinders 1 are formed with uniformly distributed perforations 12. Before being placed in the autoclave the coils E1 and E2 are each enclosed in a cylindrical jacket 3 formed on its periphery with perforations 4 similar to the perforations 12.

After they have been placed in the autoclave 2, the open end 11 of the cylinders 1 faces one of the ends of a treatment liquid circuit 5. The second end thereof is connected to an orifice 13 provided for this purpose in the autoclave 2. The circuit 5 also has a pump 6 adapted to deliver as shown by the arrow X, treatment (boiling-off, bleaching or rinsing) liquid previously introduced into the autoclave through the feed or emptying opening 7.

The direction of operation of the pump 6 is such that the treatment liquid first enters the interior of the cylinder 1 through the open end 11, as shown by the arrow X, then discharges through the orifices 12, as shown by the arrows a, to pass through the coils E1 and E2 and then discharge through the orifices 4 in the jackets 3, as shown by the arrows b, and then collects, as shown by the arrow Y, at the orifice 13 of the autoclave 2 to be taken in by the pump 6 and delivered, as shown by the arrow X, and returned to the cylinder 1.

In accordance with the invention therefore, the treatment liquid circulates, as shown by the arrows a, through the turns of the coils E1 and E2. This liquid, which for boiling-off consists of soda at a temperature of about 130° C., of hydrogen peroxide for bleaching and of pure water for rinsing which must be carried out downstream has some difficulty in flowing through the coils E1 and E2. A pressure difference therefore arises between the treatment liquid leaving the jackets 3, as shown by the arrows b, and collecting at the opening 13 of the autoclave 2, as shown by the arrow Y, and the liquid arriving, as shown by the arrow X, inside the cylinder 1. This pressure difference is detected by means of an upstream and a downstream manometer 8, 9 respectively disposed in the treatment liquid circuit upstream and downstream of the coils E1 and E2.

Controlling this pressure difference is of fundamental importance for the invention as a means of measuring the volume hydraulic tufting effect on all the turns constituting the coils E1 and E2.

The direction of flow through the bath can be reversed without departing from the scope of the invention.

The hydraulic tufting effect just referred to could be achieved similarly if the coils E1, E2 were given merely the boiling-off treatment. However, the bleaching treatment is necessary in order to offer a white web for sale.

Web cohesion varies with the pressure difference measured by the manometers 8 and 9. The required cohesion varies according to the end use of the cotton web, in particular, it must be greater in the case of cotton for removing make-up than in the case of baby hygiene products. The circuit 5 therefore has a bypass 14 having an adjustable valve 15. Varying the setting of the valve 15 varies the pressure difference between the liquid X entering the coils E1 and E2 and the liquid Y leaving them. This alters, the properties of the final web delivered from the autoclave 2 when the coils E1 and E2 are unwound. However, this pressure difference, which is measured continuously in operation, is usually adjusted to be not lower than 400 grammes, correspond to an upstream pressure of 1.4 kg and a downstream pressure of 1 kg for the products referred to, that is to say make-up removers.

However, the invention is not limited to make-up removal products and can be used to prepare looser products based on lower pressure differences and more compact products based on higher pressure differences.

APPENDIX 1

Study of the compared apparent density of round wads of cotton obtained in conformity with the employment of the method with which the invention is concerned (Specimen 1) and rounds wads of cotton obtained in conformity with prior art processes (Specimens 2, 3, 4 and 5).

| Specimen | Ratio = Weight of the specimen / Value read on the water column of the apparatus |
|---|---|
| Specimen 1 | 0.820 |
| Specimen 2 | 0.503 |
| Specimen 3 | 0.635 |
| Specimen 4 | 0.627 |
| Specimen 5 | 0.598 |

APPENDIX 2

Study of resistance to stretching. Force corresponding to maximum elongation of discs (Newtons).

| Specimen | Machine direction | Transverse direction |
|---|---|---|
| Specimen no 1 | 16.15 | 12.30 |
| Specimen no 2 | 8.20 | 4.35 |
| Specimen no 3 | 4.80 | 4.80 |
| Specimen no 4 | 3 | 2.1 |
| Specimen no 5 | 10.25 | 2.45 |
| | Corresponding elongation (mm) | |
| Specimen no 1 | 11.3 | 18.3 |
| Specimen no 2 | 15.8 | 23.7 |
| Specimen no 3 | 24.9 | 24.9 |
| Specimen no 4 | 28.7 | 27.9 |
| Specimen no 5 | 18.1 | 32.1 |

APPENDIX 3

Value of the elongation: k=force/elongation (Newton/cm).

| Specimen | k machine direction | k' transverse direction |
|---|---|---|
| Specimen no 1 | 14.3 | 6.7 |
| Specimen no 2 | 5.2 | 1.8 |
| Specimen no 3 | 1.9 | 1.9 |
| Specimen no 4 | 1.0 | 0.8 |
| Specimen no 5 | 5.7 | 0.8 |

APPENDIX 4

Study of the resistance to tearing in the direction of the thickness.

| Specimen | Force corresponding to maximum elongation (Newtons) |
|---|---|
| Specimen no 1 | 3.40 |
| Specimen no 2 | 2.50 |
| Specimen no 3 | 2.35 |
| Specimen no 4 | 2.75 |
| Specimen no 5 | 2.85 |

APPENDIX 5

Study of the absorption properties.

| Specimen | Weight of a disc | Maximum quantity of water absorbed | % of its weight absorbed by each round wad | Speed of absorption seconds. |
|---|---|---|---|---|
| specimen no 1 | 0.685 | 4.49 | 6.6 | 10.3 |
| specimen no 2 | 0.637 | 5.93 | 9.3 | 8.0 |
| specimen no 3 | 0.726 | 6.68 | 9.2 | 6.0 |
| specimen no 4 | 0.694 | 6.32 | 9.1 | 6.4 |
| specimen no 5 | 0.649 | 5.58 | 6.6 | 6.5 |

APPENDIX 6

2 $cm^3$ of water
Specimen 3
Specimen 2
Specimen 5
Specimen 1
Specimen 4

APPENDIX 7

2 $cm^3$ PEG
viscosity 80 CP
Specimen 5
Specimen 4
Specimen 2
Specimen 3
Specimen 1

APPENDIX 8

Variation of the saturation thresholds with the quantity of water injected.

| Specimen | 2 $cm^3$ of water | 3 $cm^3$ of water |
|---|---|---|
| specimen 1 | 1 700 | 1 700 |
| specimen 2 | 2 700 | 1 200 |
| specimen 3 | 3 000 | 2 500 |
| specimen 4 | 1 500 | 1 400 |
| specimen 5 | 2 500 | 1 600 |

I claim:

1. A method of making a hydrophilic cotton fleece from fibers of raw cotton, in which the raw cotton is subjected successively to standard operations and preliminary beating and opening, more particularly on carding machines, so as to obtain cotton in flocks which are opened and physically cleaned, these flocks are taken to perforated cylinders on which they deposit themselves fairly uniformly to form a fleece which is fluffy and has practically no cohesion, this fleece is taken to a wetting bath consisting of warm water to which a wetting agent is added so as to obtain a fleece which is more compact and has a certain firmness by physical cohesion, and then, when the material leaves the wetting bath, this fleece is dried between calender rollers, and is wound on a perforated cylinder so as to obtain a coil which is then introduced into an autoclave to undergo boiling and bleaching operations, and then the coil is removed from the autoclave and squeezed and dried in a way known per se, characterised in that during the operations of boiling and bleaching in the autoclave, treatment liquids are caused to pass through each of the cylinder perforations perpendicular to its axis, thereby to circulate radially through the turns of the coil in such a way that a differential pressure is established between the liquid entering the coil and the liquid leaving it, by reason of the losses of load due to the difficulty which the liquid experiences in passing through the coil, and this differential pressure brings about displacement and tangling of the cotton fibers because of the effect of hydraulic tufting on the whole of the volume of cotton distributed over the coil, thus considerably increasing the cohesion of the fleece obtained after unwinding.

2. A method according to claim 1, characterised in that the autoclave is connected to a closed treatment liquid circulation circuit composing a channel through which the liquid enters the coil, a channel through which this liquid leaves the coil, and a pump capable of drawing in the liquid coming from the coil and sending it back to the coil.

3. A method according to claim 2, characterised in that the closed liquid circulation circuit comprises a bypass duct in which there is an adjustable valve and which is provided between the channel through which the treatment liquid enters and the channel through which this liquid leaves, and a change in the adjustment of the valve brings about a change in the differential pressure that exists between the entry to and the exit from the coil, and consequently a change in the properties of the unwound fleece leaving the autoclave.

4. A method according to any one of claims 1 and 2, characterised in that before the fleece is subjected to the operations of boiling and bleaching in the autoclave, the fleece is wound on a hollow cylinder comprising perforations uniformly distributed over the surface of the cylinder, and the coil thus obtained is enclosed in a cylindrical jacket, preferably a metal jacket, having on its periphery perforations in generally axial alignment with those provided on the cylinder, before the coil is placed in the autoclave, and the cylinder is connected to the channel through which the liquid is brought in and the autoclave is provided with an orifice through which the liquid leaves the autoclave.

5. A method according to claim 2, characterised in that the differential pressure is approximately equal to 400 grammes.

* * * * *